US010145239B1

(12) United States Patent
Chin et al.

(10) Patent No.: US 10,145,239 B1
(45) Date of Patent: Dec. 4, 2018

(54) FLOW MODULATOR FOR USE IN A DRILLING SYSTEM

(71) Applicant: General Electric Company, Schenectady, NY (US)

(72) Inventors: Wilson Chun-Ling Chin, Edmond, OK (US); Shadi Saleh, Houston, TX (US); Stewart Blake Brazil, Edmond, OK (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/604,018

(22) Filed: May 24, 2017

(51) Int. Cl.
*E21B 47/18* (2012.01)
*E21B 44/00* (2006.01)

(52) U.S. Cl.
CPC ..... *E21B 47/182* (2013.01); *E21B 44/00* (2013.01); *E21B 47/18* (2013.01); *E21B 47/187* (2013.01)

(58) Field of Classification Search
CPC ..... E21B 47/12; E21B 47/14; E21B 47/18; E21B 47/182; E21B 47/185; E21B 47/187; E21B 44/00
See application file for complete search history.

(56) References Cited

U.S. PATENT DOCUMENTS 5,583,827 A 12/1996 Chin
5,586,083 A * 12/1996 Chin ..... E21B 47/18 175/48
6,219,301 B1 4/2001 Moriarty
7,145,834 B1 12/2006 Jeter
8,151,905 B2 * 4/2012 Song ..... E21B 47/182 175/40
2004/0156265 A1 8/2004 Lavrut et al.
2008/0179093 A1 7/2008 Kusko et al.
2016/0201437 A1 7/2016 Chin et al.
2016/0201438 A1 * 7/2016 Chin ..... E21B 47/18 175/40

OTHER PUBLICATIONS

Boling, Brian, "An Innovative High-Temperature High-Pressure Measurement While Drilling (MWD) Tool", Final Technical Report, United States Department of Energy, National Energy Technology Laboratory, Jul. 16, 2008, 55 pp.
Yinao, Su et al., "Strategies in High-Data-Rate MWD Mud Pulse Telemetry", Journal of Sustainable Energy Engineering, vol. 2, No. 3, Dec. 2014, 51 pp.
"Multi-mode Telemetry and Power System for Electric Down-hole Tools", The IP.com Prior Art Database, Feb. 10, 2015, 5 pp.

* cited by examiner

*Primary Examiner* — Hai Phan
*Assistant Examiner* — Franklin Balseca
(74) *Attorney, Agent, or Firm* — Armstrong Teasdale LLP

(57) ABSTRACT

A drilling system including a sensor configured to monitor at least one drilling parameter, and configured to generate a signal based on the at least one drilling parameter. An encoder is in communication with the sensor, and the encoder is configured to convert the signal into a modulation signal. A flow modulator is configured to channel drilling fluid therethrough. The flow modulator includes at least one stator element and a rotor element configured to freely rotate relative to the at least one stator element as the drilling fluid flows past the rotor element. A braking system is in communication with the encoder, and the braking system is configured to selectively decrease a rotational speed of the rotor element based on the modulation signal such that an encoded acoustic signal is emitted from the flow modulator through the drilling fluid.

18 Claims, 3 Drawing Sheets

FLOW MODULATOR FOR USE IN A DRILLING SYSTEM

BACKGROUND

The present disclosure relates generally to oil and gas well drilling systems and, more specifically, to a self-powering flow modulator (i.e., a mud siren) having enhanced signal generation capabilities.

At least some known oil and gas wells are formed by drilling a wellbore into a subterranean rock formation. During some known drilling operations, drilling mud is circulated through a drill string to cool a drill bit as it cuts through the subterranean rock formations, and is circulated to carry cuttings out of the wellbore. As drilling technologies have improved, "measurement while drilling" techniques have been developed that allow the driller to accurately identify the location of the drill string and drill bit and the conditions in the wellbore. Measurement while drilling equipment often includes one or more sensors that detect an environmental condition, or drilling position, and relay that information back to the surface. This information can be relayed to the surface using acoustic signals that carry encoded data relating to the measured condition. In at least some known systems, the acoustic signals are generated by a flow modulator device that creates rapid changes in the pressure of the drilling mud channeled through the drill string. However, the flow modulator device is typically powered by a battery, which has a limited power supply, or a power-generating turbine, which increases the complexity and capital costs associated with the measurement while drilling equipment.

BRIEF DESCRIPTION

In one aspect, a drilling system is provided. The system includes a sensor configured to monitor at least one drilling parameter, and configured to generate a sensor signal based on the at least one drilling parameter. An encoder is in communication with the sensor, and the encoder is configured to convert the sensor signal into a modulation signal. A flow modulator is configured to channel drilling fluid therethrough. The flow modulator includes at least one stator element and a rotor element configured to freely rotate relative to the at least one stator element as the drilling fluid flows past the rotor element. A braking system is in communication with the encoder, and the braking system is configured to selectively decrease a rotational speed of the rotor element based on the modulation signal such that an encoded acoustic signal is emitted from the flow modulator through the drilling fluid.

In another aspect, a drilling system is provided. The system includes a drill string and a sensing sub-assembly coupled along said drill string, said sensing sub-assembly comprising a sensor configured to monitor at least one drilling parameter, and configured to generate a sensor signal based on the at least one drilling parameter. A measurement while drilling sub-assembly is coupled along the drill string. The measurement while drilling sub-assembly includes an encoder in communication with the sensor, and the encoder is configured to convert the sensor signal into a modulation signal. A flow modulator is configured to channel drilling fluid therethrough, and the flow modulator includes at least one stator element and a rotor element configured to freely rotate relative to he at least one stator element as the drilling fluid flows past the rotor element. A braking system is in communication with the encoder, wherein the braking system is configured to selectively decrease a rotational speed of the rotor element based on the modulation signal such that an encoded acoustic signal is emitted from the flow modulator through the drilling fluid.

In yet another aspect, a flow modulator configured to channel drilling fluid therethrough is provided. The flow modulator includes at least one stator element including a first stator element a second stator element. A rotor element is positioned between the first stator element and the second stator element, wherein the rotor element is configured to freely rotate relative to the first stator element and the second stator element as the drilling fluid flows past the rotor element, and wherein a rotational speed of the rotor element is selectively decreased such that an encoded acoustic signal is emitted from the flow modulator through the drilling fluid.

DRAWINGS

These and other features, aspects, and advantages of the present disclosure will become better understood when the following detailed description is read with reference to the accompanying drawings in which like characters represent like parts throughout the drawings, wherein.

Figure 1:
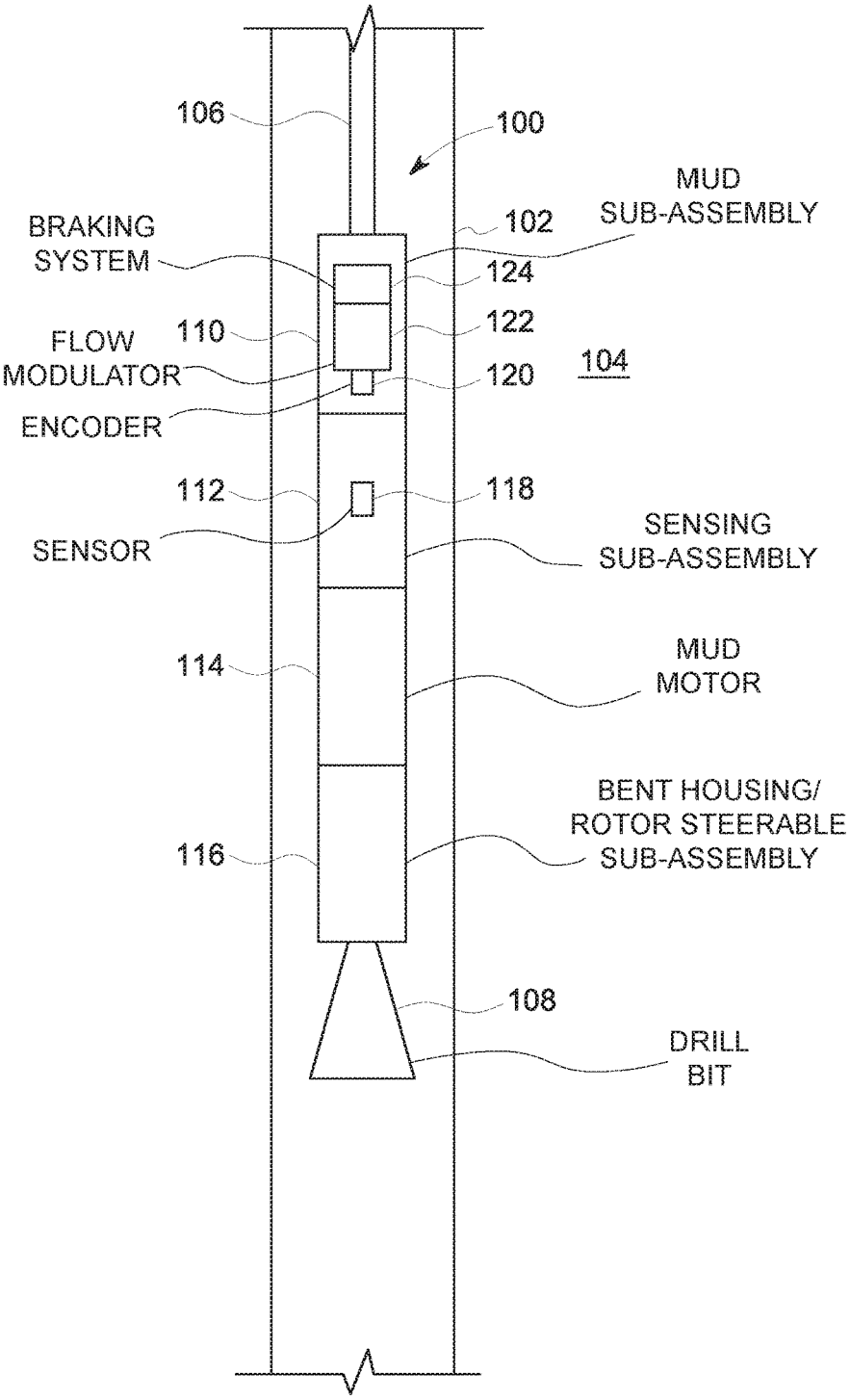
FIG. 1 is a schematic illustration of an exemplary drilling system that may be used to form a wellbore.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Embodiments of the present disclosure relate to a self-powering flow modulator (i.e., a mud siren) having enhanced signal generation capabilities. More specifically, the flow modulator includes at least one stator element and a rotor element that is freely rotatable relative to the stator element. The rotor element is freely rotatable when impinged by drilling fluid channeled through the flow modulator, and thus is capable of generating power when electrically coupled to an alternator. The power generated by the rotor element may then be used to power the flow modulator itself, or other components in a drilling assembly, such as sensors and motors, for example. As such, the flow modulator is operable without the use of an external power source or actuating mechanism.

In addition, the flow modulator is capable of emitting acoustic signals therefrom to facilitate relaying drilling information to a surface site through the drilling fluid. More specifically, the flow modulator emits an acoustic signal at a first frequency when at a first rotational speed, and emits an acoustic signal at a second frequency when at a second rotational speed different from the first rotational speed. The rotational speed of the flow modulator is controlled, and the frequency of the acoustic signal is modulated, with a braking system that selectively decreases the rotational speed of the rotor element from the freely rotatable rotational speed. Modulating the frequency of the acoustic signal in a controlled manner facilitates encoding the acoustic signal, which may then be decoded at the surface site to decipher the drilling information.

As used herein, the terms "axial" and "axially" refer to directions and orientations that extend substantially parallel to a longitudinal axis of the flow modulator. Moreover, the terms "radial" and "radially" refer to directions and orientations that extend substantially perpendicular to the longitudinal axis of the flow modulator. In addition, as used herein, the terms "circumferential" and "circumferentially" refer to directions and orientations that extend arcuately about the longitudinal axis of the flow modulator.

FIG. 1 is a schematic illustration of an exemplary drilling system 100 that may be used to form a wellbore 102 in a subterranean rock formation 104. In the exemplary embodiment, drilling system 100 includes a drill string 106, and a drill bit 108 and a plurality of sub-assemblies coupled along drill string 106. More specifically, the plurality of sub-assemblies includes a measurement while drilling (MWD) sub-assembly 110, a sensing sub-assembly 112, a mud motor 114, and a bent housing or rotary steerable system sub-assembly 116 coupled together in series. Alternatively, drilling system 100 includes any arrangement of sub-assemblies that enables drilling system 100 to function as described herein.

In the exemplary embodiment, sensing sub-assembly 112 includes at least one sensor 118 that monitors at least one drilling parameter, such as an operational status of drilling system 100 and environmental conditions within wellbore 102, for example. In addition, MWD sub-assembly 110 includes an encoder 120 in communication with sensor 118, and a flow modulator 122 that channels drilling fluid therethrough. Sensor 118 generates a sensor signal based on the at least one drilling parameter, which is then transmitted to encoder 120. The sensor signal includes drilling parameter data, and encoder 120 converts the sensor signal into a modulation signal. Moreover, MWD sub-assembly 110 includes a braking system 124 in communication with encoder 120, and that is used to control the operation of flow modulator 122 such that an encoded acoustic signal is emitted therefrom through the drilling fluid, as will be explained in further detail below. In an alternative embodiment, MWD sub-assembly 110 includes more than one flow modulator 122.

In one embodiment, braking system 124 is an electromagnetic braking system including at least one magnet and at least one coil. The electromagnetic braking system also includes electrical components such as a rectifier, a switch, and a resistor. The electrical components are operable to inject current into braking system 124 to provide a counteracting torque on flow modulator 122, or to load braking system 124 such that current or voltage is absorbed through the inductance and resistance of braking system 124. As such, the torque and rotational speed of flow modulator 122 are controlled in an accurate and responsive manner to modulate the frequency and shape of the acoustic signal transmitted through the drilling fluid. Alternatively, a mechanical brake frictionally coupled to rotating components of flow modulator 122 may be used to selectively decrease the rotational speed thereof. Further, alternatively, MWD sub-assembly 110 further includes a supplemental motor that facilitates controlling the rotational speed of flow modulator 122.

Figure 2:
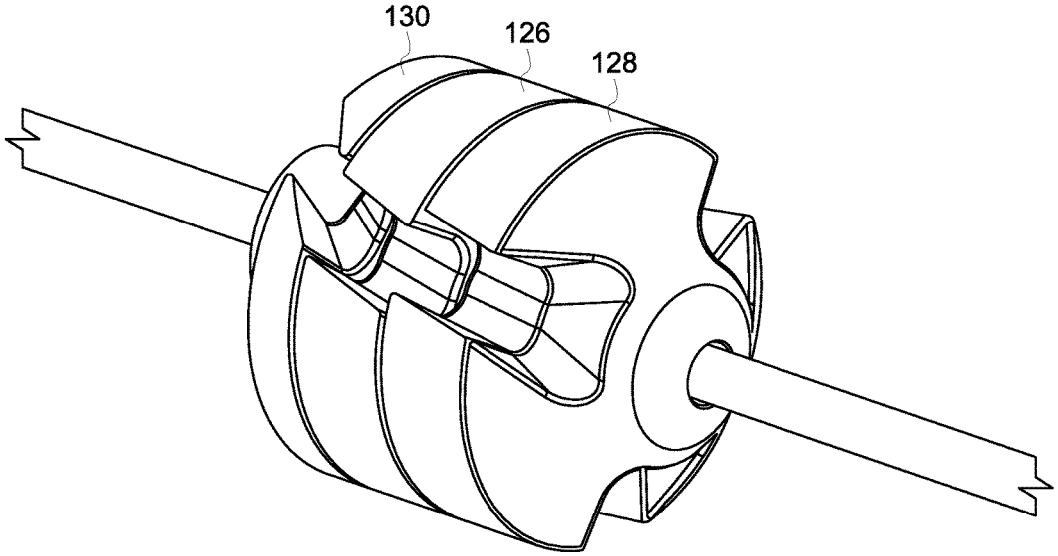
FIG. 2 is a partial cutaway view of an exemplary flow modulator that may be used in the drilling system shown in FIG. 1.
Figure 3:
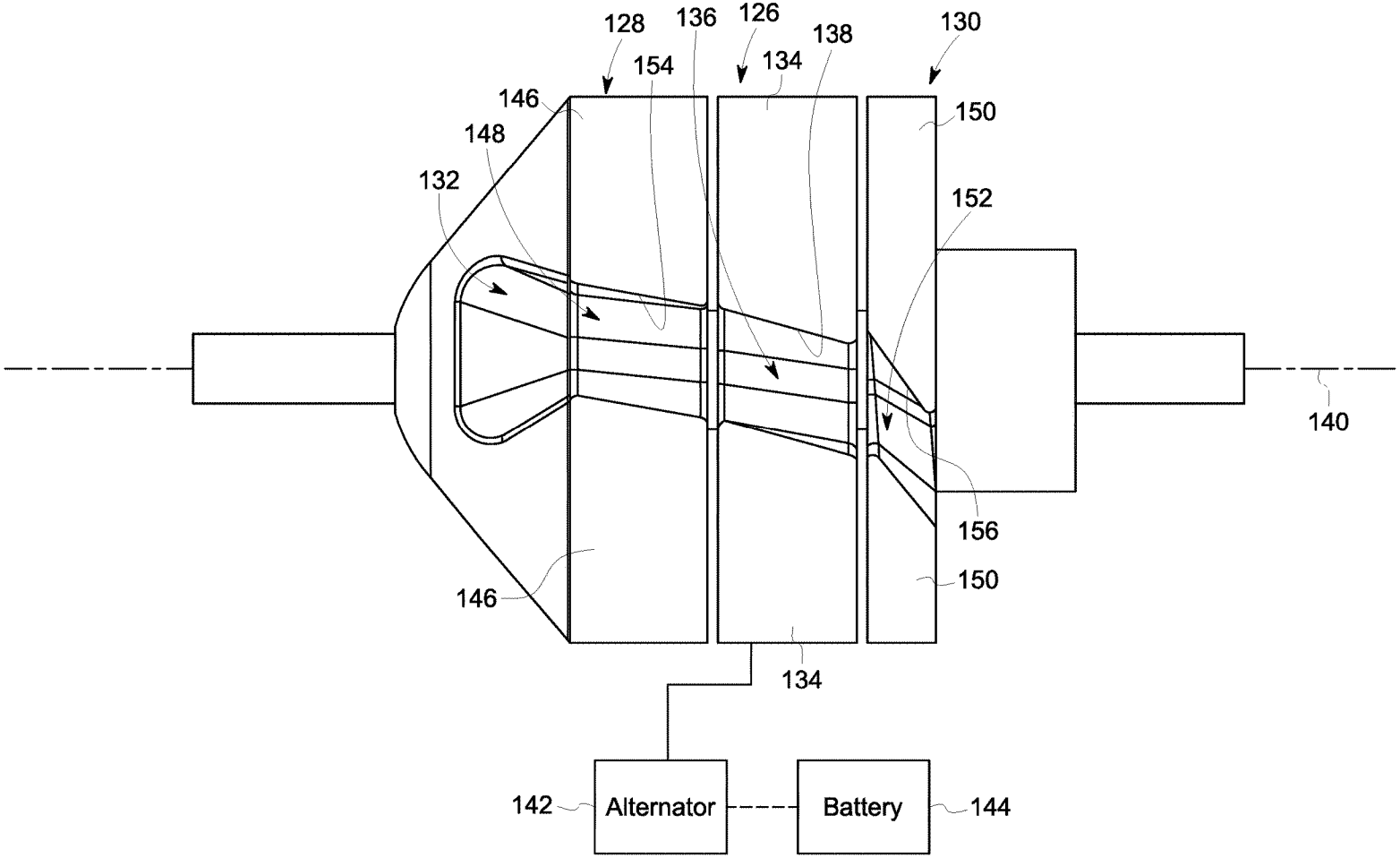
FIG. 3 is a side view of the flow modulator shown in FIG. 2.

FIG. 2 is a partial cutaway view of flow modulator 122 that may be used in drilling system 100 (shown in FIG. 1), and FIG. 3 is a side view of flow modulator 122. In the exemplary embodiment, flow modulator 122 includes at least one stator element and a rotor element 126. More specifically, flow modulator 122 includes a first stator element 128 and a second stator element 130, and rotor element 126 is positioned between first stator element 128 and second stator element 130. As such, the magnitude of an acoustic signal emitted from flow modulator 122 is increased when compared to an assembly including a single stator element.

As will be explained in more detail below, rotor element 126, first stator element 128, and second stator element 130 are designed to enable drilling fluid to be channeled through flow modulator 122. Rotor element 126 freely rotates relative to first stator element 128 and second stator element 130 as the drilling fluid flows past and impinges against rotor element 126. As such, rapid variations in the size of a flow path 132 (shown in FIG. 3) extending through rotor element 126, first stator element 128, and second stator element 130 facilitates increasing and decreasing the pressure of the drilling fluid channeled therethrough. The variations in pressure facilitate forming an acoustic signal that is then transmitted through the drilling fluid and towards a surface site, for example.

For example, rotor element 126 freely rotates at a first rotational speed, and braking system 124 (shown in FIG. 1) selectively decreases the rotational speed of rotor element 126 to a second rotational speed lower than the first rotational speed. As such, flow modulator 122 emits an acoustic signal having a first frequency when at the first rotational speed, and emits an acoustic signal having a second frequency when at the second rotational speed. As noted above, braking system 124 controls the operation of flow modulator 122 based on the modulation signal received from encoder 120 such that an encoded acoustic signal is emitted from flow modulator 122 through the drilling fluid. More specifically, the modulation signal causes flow modulator 122 to cycle between rotating at the first rotational speed and the second rotational speed. As such, the acoustic signal emitted from flow modulator 122 is encoded in binary, wherein the first frequency corresponds to a "one" and the second frequency corresponds to a "zero" in a binary sequence. The encoded acoustic signal is then decoded, and the drilling parameter data contained in the encoded acoustic signal may then be used to control operation of drilling system 100, for example.

Referring to FIG. 3, rotor element 126 includes a plurality of rotor vanes 134 and a rotor flow passage 136 defined between adjacent rotor vanes 134. In the exemplary embodiment, rotor vanes 134 are pitched to induce free rotation of rotor element 126 when impinged by the drilling fluid. More specifically, each rotor vane 134 includes a radial side wall 138 that is oriented obliquely relative to a longitudinal axis 140 of flow modulator 122. As such, radial side wall 138 is oriented such that the drilling fluid channeled along longitudinal axis 140 impinges against rotor vanes 134, thereby causing rotor element 126 to rotate. In addition, rotor flow passage 136 is defined by adjacent radial side walls 138, and is oriented to channel the drilling fluid therethrough obliquely relative to longitudinal axis 140 of flow modulator 122.

As noted above, rotor element 126 freely rotates when impinged by drilling fluid channeled through flow modulator 122. In one embodiment, drilling system 100 further includes an alternator 142 coupled to rotor element 126 and a battery 144 electrically coupled to alternator 142. Alternator 142 generates power as rotor element 126 freely rotates, and battery 144 stores the power received from alternator 142. Battery 144 may then distribute the power to other electrical components within drilling system 100 such as, but not limited to, braking system 124, sensing sub-assembly 112, mud motor 114, and bent housing or rotary steerable system sub-assembly 116 (all shown in FIG. 1). As such, electrical components of drilling system 100 may be powered in perpetuity and without the use of a secondary power source. In an alternative embodiment, drilling system 100 includes a secondary power source, such as a power-generating turbine, to supplement the power generated by alternator 142.

Moreover, first stator element 128 includes a plurality of first stator vanes 146 and a first stator flow passage 148 defined between adjacent first stator vanes 146, and second stator element 130 includes a plurality of second stator vanes 150 and a second stator flow passage 152 defined between adjacent second stator vanes 150. In the exemplary embodiment, first stator vanes 146 and second stator vanes 150 are pitched such that the drilling fluid is channeled therethrough obliquely relative to longitudinal axis 140 of flow modulator 122. More specifically, first stator vanes 146 include a radial side wall 154 and second stator vanes 150 include a radial side wall 156 that are both oriented obliquely relative to longitudinal axis 140. In one embodiment, radial side wall 156 is pitched at a greater degree than radial side wall 154 relative to longitudinal axis 140. As such, a balance between generating a sufficient signal strength for the encoded acoustic signal and generating sufficient power is provided.

An exemplary technical effect of the drilling system described herein includes at least one of: (a) transmitting encoded acoustic signals through a fluid medium; (b) configuring the rotatable elements of the drilling system to freely rotate, and thus provide power for electrical components of the system when coupled to an alternator; and (c) increasing a signal strength of the acoustic signals emitted from the flow modulator.

Exemplary embodiments of a flow modulator for use in a drilling system are provided herein. The flow modulator is not limited to the specific embodiments described herein, but rather, components of systems and/or steps of the methods may be utilized independently and separately from other components and/or steps described herein. For example, the configuration of components described herein may also be used in combination with other processes, and is not limited to practice with only downhole drilling systems, as described herein. Rather, the exemplary embodiment can be implemented and utilized in connection with many applications where transmitting acoustic signals through a fluid is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A drilling system comprising:

a sensor configured to monitor at least one drilling parameter, and configured to generate a sensor signal based on the at least one drilling parameter;

an encoder in communication with said sensor, wherein said encoder is configured to convert the sensor signal into a modulation signal; and a flow modulator configured to channel drilling fluid therethrough, said flow modulator comprising:

at least one stator element;

a rotor element configured to freely rotate relative to said at least one stator element as the drilling fluid flows past said rotor element, wherein said rotor element comprises a plurality of rotor vanes pitched to induce free rotation of said rotor element when impinged by the drilling fluid; and a braking system in communication with said encoder, wherein said braking system is configured to selectively decrease a rotational speed of said rotor element based on the modulation signal such that an encoded acoustic signal is emitted from said flow modulator through the drilling fluid.

2. The drilling system in accordance with claim 1, wherein said at least one stator element comprises a first stator element and a second stator element, said rotor element positioned between said first stator element and said second stator element.

3. The drilling system in accordance with claim 1, wherein said rotor element is configured to freely rotate at a first rotational speed, and said braking system is configured to selectively decrease the rotational speed of said rotor element to a second rotational speed, wherein said flow modulator is configured to emit the encoded acoustic signal having a first frequency when at the first rotational speed, and is configured to emit the encoded acoustic signal having a second frequency when at the second rotational speed.

4. The drilling system in accordance with claim 1 further comprising:

an alternator coupled to said rotor element, said alternator configured to generate power as said rotor element freely rotates; and a battery electrically coupled to said alternator, wherein said battery is configured to store the power received from said alternator.

5. The drilling system in accordance with claim 1, wherein said flow modulator is a mud siren.

6. The drilling system in accordance with claim 1, wherein said plurality of rotor vanes are spaced circumferentially from each other such that an angled flow passage is defined between adjacent rotor vanes, said angled flow passage oriented to channel the drilling fluid therethrough obliquely relative to a longitudinal axis of said flow modulator.

7. The drilling system in accordance with claim 1, wherein said at least one stator element comprises a plurality of stator vanes pitched to channel the drilling fluid therethrough obliquely relative to a longitudinal axis of said flow modulator.

8. The drilling system in accordance with claim 1, wherein said braking system comprises an electromagnetic braking system.

9. A drilling system comprising:

a drill string;

a sensing sub-assembly coupled along said drill string, said sensing sub-assembly comprising a sensor configured to monitor at least one drilling parameter, and configured to generate a sensor signal based on the at least one drilling parameter; and a measurement while drilling sub-assembly coupled along said drill string, said measurement while drilling sub-assembly comprising:

an encoder in communication with said sensor, wherein said encoder is configured to convert the sensor signal into a modulation signal; and a flow modulator configured to channel drilling fluid therethrough, said flow modulator comprising:

at least one stator element;

a rotor element configured to freely rotate relative to said at least one stator element as the drilling fluid flows past said rotor element, wherein said rotor element comprises a plurality of rotor vanes pitched to induce free rotation of said rotor element when impinged by the drilling fluid; and a braking system in communication with said encoder, wherein said braking system is configured to selectively decrease a rotational speed of said rotor element based on the modulation signal such that an encoded acoustic signal is emitted from said flow modulator through the drilling fluid.

10. The drilling system in accordance with claim 9, wherein said at least one stator element comprises a first stator element and a second stator element, said rotor element positioned between said first stator element and said second stator element.

11. The drilling system in accordance with claim 9, wherein said rotor element is configured to freely rotate at a first rotational speed, and said braking system is configured to selectively decrease the rotational speed of said rotor element to a second rotational speed, wherein said flow modulator is configured to emit the encoded acoustic signal having a first frequency when at the first rotational speed, and is configured to emit the encoded acoustic signal having a second frequency when at the second rotational speed.

12. The drilling system in accordance with claim 9 further comprising an alternator coupled to said rotor element, said alternator configured to generate power as said rotor element freely rotates.

13. The drilling system in accordance with claim 12 further comprising a battery electrically coupled to said alternator, wherein said battery is configured to store the power received from said alternator.

14. The drilling system in accordance with claim 9, wherein said braking system comprises an electromagnetic braking system.

15. A flow modulator configured to channel drilling fluid therethrough, said flow modulator comprising:

at least one stator element comprising a first stator element a second stator element; and a rotor element positioned between said first stator element and said second stator element, wherein said rotor element is configured to freely rotate relative to said first stator element and said second stator element as the drilling fluid flows past said rotor element, wherein said rotor element comprises a plurality of rotor vanes pitched to induce free rotation of said rotor element when impinged by the drilling fluid, and wherein a rotational speed of said rotor element is selectively decreased such that an encoded acoustic signal is emitted from the flow modulator through the drilling fluid.

16. The flow modulator in accordance with claim 15, wherein said plurality of rotor vanes are spaced circumferentially from each other such than an angled flow passage is defined between adjacent rotor vanes, said angled flow passage oriented to channel the drilling fluid therethrough obliquely relative to a longitudinal axis of said flow modulator.

17. The flow modulator in accordance with claim 15, wherein said at least one stator element comprises a plurality of stator vanes pitched to channel the drilling fluid therethrough obliquely relative to a longitudinal axis of said flow modulator.

18. The flow modulator in accordance with claim 17, wherein said plurality of stator vanes are spaced circumferentially from each other, said plurality of stator vanes pitched such that an angled flow passage is defined between adjacent stator vanes.

* * * * *